US005082440A

United States Patent [19]

Yamamoto

[11] Patent Number: 5,082,440

[45] Date of Patent: Jan. 21, 1992

[54] HANDY COMPACT TORCH

[75] Inventor: Akira Yamamoto, Gamagori, Japan

[73] Assignee: Shin Fuji Burner Co., Ltd., Aichi, Japan

[21] Appl. No.: 634,548

[22] Filed: Dec. 27, 1990

[51] Int. Cl.[5] ..... F23Q 2/00

[52] U.S. Cl. ..... 431/143; 431/255; 431/344

[58] Field of Search ..... 431/255, 344, 345, 255, 431/256, 264, 266, 142, 143

[56] References Cited

U.S. PATENT DOCUMENTS 4,253,820 3/1981 Jarreau ..... 431/344
4,538,984 9/1985 Nakagawa ..... 431/255
4,810,187 3/1989 Nitta ..... 431/344

FOREIGN PATENT DOCUMENTS 2411363 8/1979 France ..... 431/344
38820 2/1988 Japan ..... 431/255

*Primary Examiner*—James C. Yeung
*Attorney, Agent, or Firm*—Wenderoth, Lind & Ponack

[57] ABSTRACT

A handy compact torch having a holder for accommodating a handy lighter having a container for a fuel gas, an injection nozzle for discharging the fuel gas, and a push button for controlling the supply of the fuel gas to the injection nozzle. A torch body having a torch nozzle is detachably mounted on top of the holder. It has a connecting pipe provided at the rear end of the torch nozzle and adapted to be connected to the injection nozzle of the handy lighter. A depressible firing button for emitting sparks at the end of the torch nozzle is mounted on the torch body. Link members are provided on the firing button to press down the push button of the handy lighter when the firing button is pressed down.

10 Claims, 1 Drawing Sheet

HANDY COMPACT TORCH

BACKGROUND OF THE INVENTION

The present invention relates to a handy compact torch which uses as a fuel source a handy commerically available disposable lighter.

A handy compact torch is used for the making of models and to set fire to firewood outdoors, which is difficult with a lighter.

A conventional compact torch needs a special fuel gas as a fuel source. Thus, when it runs out of fuel, the special fuel has to be purchased and replenished.

But since few shops keep such special fuel gas, it is difficult to obtain such fuel gas, especially at remote sites such as at camp sites.

SUMMARY OF THE INVENTION

An object of this invention is to provide a compact torch which can use as a fuel source handy disposable lighter which can be purchased at shops such as tobacco shops or convenience stores.

In accordance with the present invention, there is provided a handy compact torch comprising a handy lighter having a container for fuel gas, an injection nozzle for discharging the fuel gas, and a push button for controlling the supply of the fuel gas to the injection nozzle. A holder accommodates the handy lighter and a torch body is detachably mounted on top of the holder, the torch body having a torch nozzle and a connecting pipe provided at the rear end of the torch nozzle adapted to be connected to the injection nozzle of the handy lighter. A depressible firing button emits sparks at the tip of the torch nozzle, and a link is secured to the firing button to press down the push button of the lighter when the firing button is pressed down.

After accommodating a lighter in the holder, the torch body is mounted on top of the holder. In this state, the injection nozzle of the lighter communicates with the torch nozzle through the connecting pipe.

By depressing the firing button, the push button connected to the firing button by the link mechanism is pushed down. Thus the fuel gas in the lighter will flow through the injection nozzle and the connecting pipe and will be discharged from the tip of the torch nozzle. The fuel gas discharged from the torch nozzle is fired by sparks produced by depressing the firing button, bursting into flames.

By releasing the fire button, the push button of the lighter will return upwards. Thus the supply of fluid gas is cut off and the flame at the torch nozzle goes out.

According to this invention, since a disposable handy lighter, which is readily obtainable at tobacco shops or the like, can be used as a fuel source, refueling is easy.

BRIEF DESCRIPTION OF THE DRAWINGS

Other features and objects of the present invention will become apparent from the following description taken with reference to the accompanying drawings, in which.

DETAILED DESCRIPTION OF THE PREFERRED EMBODIMENT

Figure 2:
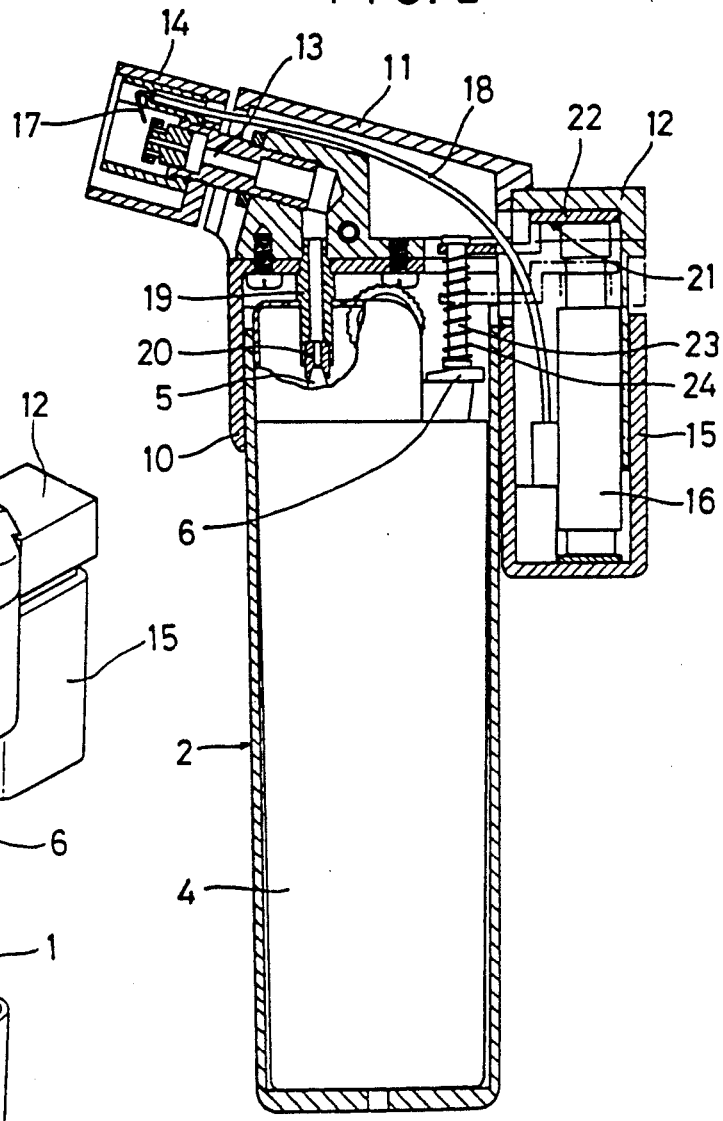
FIG. 2 is a vertical sectional view of the same.
Figure 1:
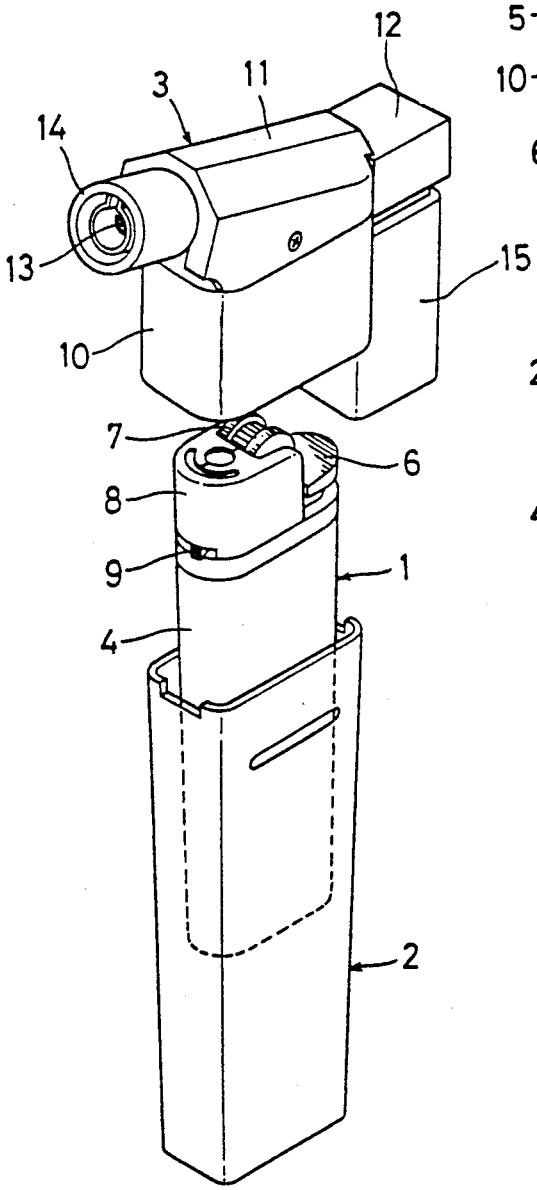
FIG. 1 is an exploded perspective view of the embodiment of the present invention.

Next, the embodiment of this invention will be described.

A compact torch according to this invention comprises a bottom-closed holder 2 for accommodating a disposable lighter 1 and a torch body 3 detachably mounted on top of the holder 2.

The handy lighter 1 comprises a gas container 4 for containing fuel gas, an injection nozzle 5 provided over the gas container 4 to discharge the fuel gas, a push button 6 for controlling the supply of the fuel gas and a firing device 7. By pushing down the push button 6, the fuel gas is discharged through the injection nozzle 5 while at the same time sparks are emitted by the firing device 7. The fuel gas catches fire and burns in a flame above a nozzle cover 8. Numeral 9 designates a lever for adjusting the supply of fuel gas. By adjusting the lever 9, the size of the flame can be controlled.

The torch body 3 comprises a cover 10 detachably put on top of the holder 2, a head cover 11 mounted on top of the cover 10, and a depressible firing button 12 provided at the rear of the cover 10. A torch nozzle 13 is provided inside the head cover 11. It has an end member 14 for mixing fuel gas into air. Under the firing button 12 is provided a body 15 of a firing device for emitting sparks at the end of the torch nozzle 13 when the firing button 12 is depressed. A piezo-electric device 16 is mounted in the body 15 and is connected through a lead wire 18 to a spark-emitting unit 17 provided near the tip of the torch nozzle 13.

A connecting pipe 19 is provided at the rear end of the torch nozzle 13 to extend downwardly from the head cover 11 into the cover 10. It is adapted to fit into the end of the injection nozzle 5 of the handy lighter 1 when the torch body 3 is mounted on the holder 2. A rubber packing 20 is fitted in the connecting pipe 19 at its lower end.

A link mechanism 21 is secured to the firing button 12 to press the push button 6 when the firing button 12 is depressed. The link mechanism 21 comprises a horizontal lever 22 and a vertical rod 23 provided at the front end of the lever 22. A coil spring 24 is put around the rod 23 to allow the upward return of the depressed firing button 12.

Next, the operation of this embodiment will be described.

By depressing the firing button 12, the push button 6 is pushed down through the link mechanism 21, i.e. the lever 22 and the rod 23, thus allowing the fuel gas in the gas container 4 of the lighter 1 to be fed through the connecting pipe 19 and discharged through the torch nozzle 13. Since the fuel gas is mixed with air before being fired by sparks produced by depressing the firing button 12, the flames are strong.

When the firing button 12 is released, the push button 6 will also return upwards. Thus the supply of fuel gas will be stopped, so that the flames at the torch nozzle 13 will be put out.

When the fuel gas in the handy lighter 1 runs out, the torch body 3 is detached from the holder 2 and the handy lighter 1 is taken out of the holder 2 and discarded. A new handy lighter 1 is set in the holder 2. Then the torch body 3 is mounted on the holder 2.

What is claimed is:

1. A torch apparatus, comprising:

a holder adapted to accommodate a lighter therein; and a torch body detachably mountable on said holder for holding the lighter in said holder, said torch body having a torch nozzle thereon, a connecting pipe means comprising a connecting pipe fluidly communicating with said torch nozzle for fluidly connecting said torch nozzle with an exit nozzle of the lighter, a firing means comprising a depressible firing button for emitting sparks at the tip of said torch nozzle and a link means connected to said depressible firing button for pressing a valve push button of the lighter when said depressible firing button is depressed.

2. The torch apparatus of claim 1, wherein:

said link means comprises a lever secured to said depressible firing button, a vertical rod provided at one end of said lever for pushing the valve push button of the lighter and a spring mounted on said vertical rod for receiving the downward force transmitted from said depressible firing button through said lever.

3. The torch apparatus of claim 1, wherein:

said holder is an elongated container having an open end for receiving the lighter therethrough; and said torch body has a cover portion for covering said open end of said elongated container and enclosing the lighter therein.

4. The torch apparatus of claim 1, wherein:

said connecting pipe means further comprises a rubber packing at one end of said connecting pipe for sealing said connecting pipe to the exit nozzle of the lighter.

5. The torch apparatus of claim 1, wherein:

said firing means further comprises a piezo-electric device connected to said depressible firing button, a wire extending from said piezo-electric device to said torch nozzle, and a spark-emitting unit at the tip of said torch nozzle connected to said wire.

6. A torch apparatus, comprising:

a holder adapted to accommodate a lighter therein;

a lighter disposed is said holder, said lighter having a fuel supply, an exit nozzle for emitting fuel from said fuel supply, and a valve push button for controlling the emission of fuel through said exit nozzle; and a torch body detachably mounted on said holder holding said lighter in said holder, said torch body having a torch nozzle thereon, a connecting pipe means comprising a connecting pipe fluidly communicating with said torch nozzle for fluidly connecting said torch nozzle with said exit nozzle of said lighter, a firing means comprising a depressible firing button for emitting sparks at the tip of said torch nozzle and a link means connected to said depressible firing button for pressing said valve push button of said lighter when said depressible firing button is depressed.

7. The torch apparatus of claim 6, wherein:

said link means comprises a lever secured to said depressible firing button, a vertical rod provided at one end of said lever for pushing said valve push button of said lighter and a spring mounted on said vertical rod for receiving the downward force transmitted from said depressible firing button through said lever.

8. The torch apparatus of claim 6, wherein:

said holder is an elongated container having an open end for receiving said lighter therethrough; and said torch body has a cover portion for covering said open end of said elongated container and enclosing said lighter therein.

9. The torch apparatus of claim 6, wherein:

said connecting pipe means further comprises a rubber packing at one end of said connecting pipe for sealing said connecting pipe to said exit nozzle of said lighter.

10. The torch apparatus of claim 6, wherein:

said firing means further comprises a piezo-electric device connected to said depressible firing button, a wire extending from said piezo-electric device to said torch nozzle, and a spark-emitting unit at the tip of said torch nozzle connected to said wire.

* * * * *